US008798300B2

(12) United States Patent
Jinton

(10) Patent No.: US 8,798,300 B2
(45) Date of Patent: Aug. 5, 2014

(54) ADJUSTABLE SPRING ASSEMBLY FOR A VIBRATOR OF A BONE ANCHORED HEARING AID

(71) Applicant: Oticon Medical A/S, Smørum (DK)

(72) Inventor: Lars Jinton, Smørum (DK)

(73) Assignee: Oticon Medical A/S, Smorum (DK)

( * ) Notice: Subject to any disclaimer, the term of this patent is extended or adjusted under 35 U.S.C. 154(b) by 41 days.

(21) Appl. No.: 13/718,591

(22) Filed: Dec. 18, 2012

(65) Prior Publication Data

US 2013/0156241 A1 Jun. 20, 2013

Related U.S. Application Data

(60) Provisional application No. 61/577,115, filed on Dec. 19, 2011.

(30) Foreign Application Priority Data

Dec. 19, 2011 (EP) ..... 11194307

(51) Int. Cl.
*H04R 25/00* (2006.01)

(52) U.S. Cl.
CPC ..... *H04R 25/606* (2013.01)
USPC ..... 381/326; 381/312

(58) Field of Classification Search
USPC ..... 381/312, 322, 326, 331, 380; 181/130, 181/134; 600/25; 607/55, 57
See application file for complete search history.

(56) References Cited

U.S. PATENT DOCUMENTS

| | | | | |
|---|---|---|---|---|
| 5,460,593 | A | 10/1995 | Mersky et al. | |
| 5,883,339 | A | 3/1999 | Greenberger | |
| 7,376,237 | B2 * | 5/2008 | Westerkull | 381/326 |
| 7,619,498 | B2 * | 11/2009 | Miura | 335/222 |
| 2006/0045298 | A1 * | 3/2006 | Westerkull | 381/326 |
| 2007/0182257 | A1 * | 8/2007 | Miura et al. | 310/15 |
| 2009/0259090 | A1 | 10/2009 | Parker | |

FOREIGN PATENT DOCUMENTS

| | | | |
|---|---|---|---|
| EP | 0 592 386 | A1 | 4/1994 |
| WO | WO 2011/005479 | A2 | 1/2011 |
| WO | WO 2011/064410 | A2 | 6/2011 |

* cited by examiner

*Primary Examiner* — Tuan D Nguyen
(74) *Attorney, Agent, or Firm* — Birch, Stewart, Kolasch & Birch, LLP

(57) ABSTRACT

Spring assembly as part of a vibrator for a bone anchored hearing aid, wherein the spring assembly comprises a suspension spring having a first end immovably connected to a mass of the vibrator and a second end immovably connected to a coupling attachable to a user's skull bone and comprised by the vibrator, wherein the spring assembly comprises an adjusting means adapted to adjust a spring rate of the suspension spring between a first spring rate and a second spring rate, the first rate being higher than the second rate, so as to move a resonance peak of the vibrator.

14 Claims, 4 Drawing Sheets

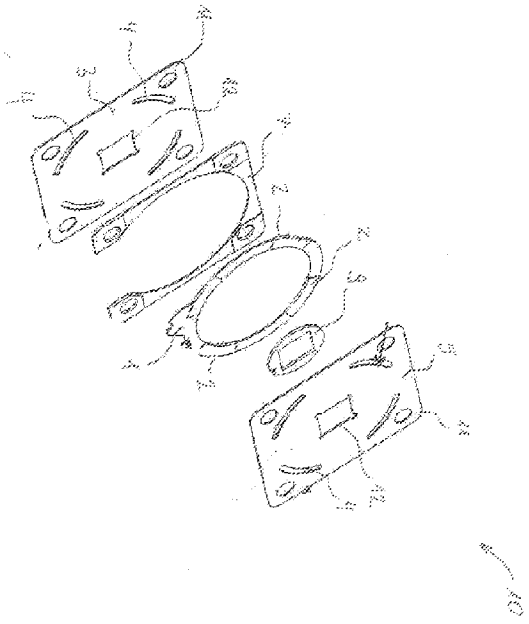
Fig. 2
Fig. 3
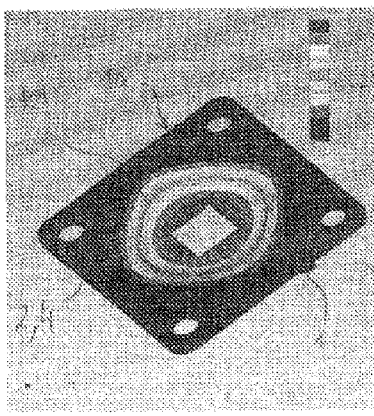
Fig. 4
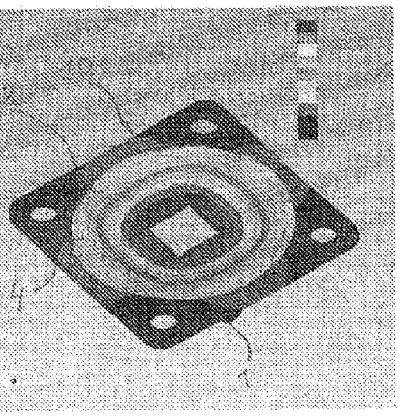

ADJUSTABLE SPRING ASSEMBLY FOR A VIBRATOR OF A BONE ANCHORED HEARING AID

CROSS-REFERENCE TO RELATED APPLICATIONS

This nonprovisional application claims the benefit of U.S. Provisional Application No. 61/577,115 filed on Dec. 19, 2011 and to Patent Application No. 11194307.2 filed on Dec. 19, 2011 in Europe. The entire contents of all of the above applications is hereby incorporated by reference.

BACKGROUND OF THE INVENTION

The invention is related to the field of bone anchored hearing aids, more specifically to a spring assembly comprising a suspension spring for use in a vibrator of a bone anchored hearing aid.

A vibrator of a bone anchored hearing aid transduces an electrical auditory signal into a mechanical stimulus perceivable by a user via bone conduction. The vibrator is a resonant system formed by an electromagnetically driven mass suspended by a suspension spring. Connected to the suspension spring is a coupling attachable to a user's skull bone. Depending on chosen weight of the mass and spring rate of the suspension spring, the vibrator resonates at a specific peak frequency.

U.S. Pat. No. 5,460,593 discloses a vibrator with a resonant system formed by a magnetostrictive rod suspended by a suspension spring designed as a washer.

It is therefore an object of the present invention to provide an alternative spring assembly.

SUMMARY OF THE INVENTION

The object of the invention is achieved by a spring assembly as part of a vibrator for a bone anchored hearing aid, wherein the spring assembly comprises a suspension spring having a first end immovably connectable to a mass of the vibrator and a second end immovably connectable to a coupling attachable to a user's skull bone and comprised by the vibrator, wherein the spring assembly comprises an adjusting means adapted to adjust a spring rate of the suspension spring between a first spring rate and a second spring rate, the first rate being higher than the second rate, so as to move a resonance peak of the vibrator.

The object of the invention is further achieved by a vibrator and a bone anchored hearing aid with such spring assembly.

It has been observed by the inventors that due to manufacturing tolerances in the suspension spring, the mass and/or the circuit electromagnetically driving the mass, the peak frequency of the vibrator may lie well outside a desired interval, resulting in a mismatch to the hearing aid's firmware and consequently to a poor production yield.

With a spring assembly according to the invention, by adjusting the spring rate of the suspension spring, a peak frequency mismatch of the vibrator can be easily compensated by moving the peak frequency into a required interval. The peak frequency of a vibrator can be moved without having to disassemble the vibrator or to replace parts. The adjustable spring assembly can advantageously be used for producing vibrators with different frequency characteristics that are made of the same part, resulting in the possibility to manufacture bone anchored hearing aids that can deliver more gain in the low or high frequency range using the same parts.

In one embodiment of the current invention the adjusting means is configured to adjust the spring rate steplessly. Thereby a resonance peak of the vibrator can be moved into a desired range precisely. A typical desired range of a resonance peak of a vibrator lies between 740 Hz and 820 Hz. Other frequencies for the resonance peak would be possible, depending on the overall design of the apparatus.

In a preferred embodiment the suspension spring is designed as a planar spring. The first end of the suspension spring is located in a peripheral, the second end in a center region of a plane of the spring. An axis of displacement is defined perpendicular to the plane and extending through the center region. Being designed as a planar spring, the suspension spring allows for flat—thus inconspicuous—design of the vibrator.

To further contribute to a flat design, the adjusting means can be embedded in the spring assembly such that the overall height of the spring assembly along the axis of displacement is constant for any adjusted spring rate. Advantageously a magnetic air gap, that is comprised by the vibrator and related to the electromagnetically driven mass, maintains a constant length along the direction of the axis of displacement for any adjusted spring rate, if the vibrator is at rest.

In a further embodiment, to prevent an undesired mass distribution when adjusting the spring rate, the adjusting means is designed as a disk-shaped plate with a center hole. The plate is rotatable against the suspension spring on the axis of displacement. The spring rate of the suspension spring is a function of the rotational angle of the plate.

In a further preferred embodiment, the adjusting means comprises a pad protruding from a plane surface of the adjusting means. A pad can protrude from either one of the two plane surfaces of the adjusting means. The pad is designed to protrude firmly against the suspension spring at any adjusted spring rate. The suspension spring comprises a slot located in the plane of the suspension spring. The pad corresponds to the slot such, that by rotating the adjusting means against the suspension spring the pad is moved gradually from a first position completely covering the slot to a second position leaving the slot completely uncovered. When the pad is in the first position it stiffens the suspension spring to have the first spring rate. When the pad is in the second position it softens the suspension spring to have the second spring rate. The spring rate can have any value between the first and second spring rate. A typical first spring rate can be 320 N/mm, a typical second spring rate can be 190 N/mm. However, the optimal spring rate is dependent from the size of the counterweight, and possibly larger or smaller spring rate would be usable, if a heavier or lighter counterweight was part of the design.

To prevent tilting of a coupling connected to the spring assembly, the suspension spring can be comprised of a base plate and a cover plate. Base plate and cover plate can be congruent. The adjusting means can be disposed between the base plate and the cover plate in a sandwiched manner. The slot can be located on the base plate and/or the cover plate.

To improve support of the adjusting means and to provide for rotational guidance, the spring assembly can comprise an outer spacer disposed between the base plate and the cover plate in a sandwiched manner. The outer spacer and the adjusting means can lie in the same plane, wherein the outer spacer is designed complementary to an outer perimeter of the adjusting means.

In a further embodiment, to prevent distortion of the spring assembly and to allow for a robust attachment of the coupling, the spring assembly comprises a center spacer disposed between the base plate and the cover plate in a sandwiched manner. The center spacer is disposed within the center hole of the adjusting means. The center spacer can reside within the center hole of the adjusting means contactless to the adjusting means. The center spacer can be laser welded to the base plate and/or the cover plate.

In a further preferred embodiment the spring assembly is attached to the mass via a fastening means. The fastening means can be provided as screws. Slightly loosening the fastening means allows for adjusting the spring constant. Retightening the fastening means prevents a self-adjustment of the spring constant when the vibrator is in operation. When the fastening means are retightened, the adjusting means is squeezed tight between the base plate and the cover plate. This embodiment allows for an even more secure adjustment of the spring rate of the vibrator.

To provide an optimal stress distribution and to facilitate an accurate assembling of the spring assembly as well as the vibrator, the base plate and the cover plate can be of square shape. The cover plate and/or the base plate can each comprise four slots in proximity to respective corners of the square. The respective slots can be equidistantly curved around the second end. The adjusting means can comprise four pads. The pads comprised by the adjusting means can firmly protrude from one plane of the adjusting means against the cover plate and from the other plane against the base plate.

In a preferred embodiment, the base plate, the cover plate and/or the outer spacer but for a recess in the outer spacer have the same circumferential square shape. The first end is designed as bores located in the respective corners of the squares defined by base plate, the cover plate and/or the outer spacer. The bores are matched to the fastening means, which are designed as screws. Preferably four screws are included.

The spring assembly can be part of a vibrator for a bone anchored hearing aid. The suspension spring's first end can be immovably connected to a mass of the vibrator. The suspension spring's second end can be immovably connected to a coupling attachable to a user's skull bone. The coupling can be provided as part of the vibrator.

Further, the spring assembly can be part of a vibrator of a bone anchored hearing aid or of an arbitrary hearing device making use of bone conduction or conduction through skin.

In the following an embodiment of the current invention is described by means of example not limiting the scope of the current invention.

BRIEF DESCRIPTION OF THE DRAWINGS

FIG. 2 schematically depicts an exploded view of the spring assembly of FIG. 1;

FIG. 3 schematically depicts a spring rate calculation of the spring assembly of FIG. 2 in a first adjustment position;

FIG. 4 schematically depicts a spring rate calculation of the spring assembly of FIG. 2 in second adjustment position;

DETAILED DESCRIPTION

Figure 1:
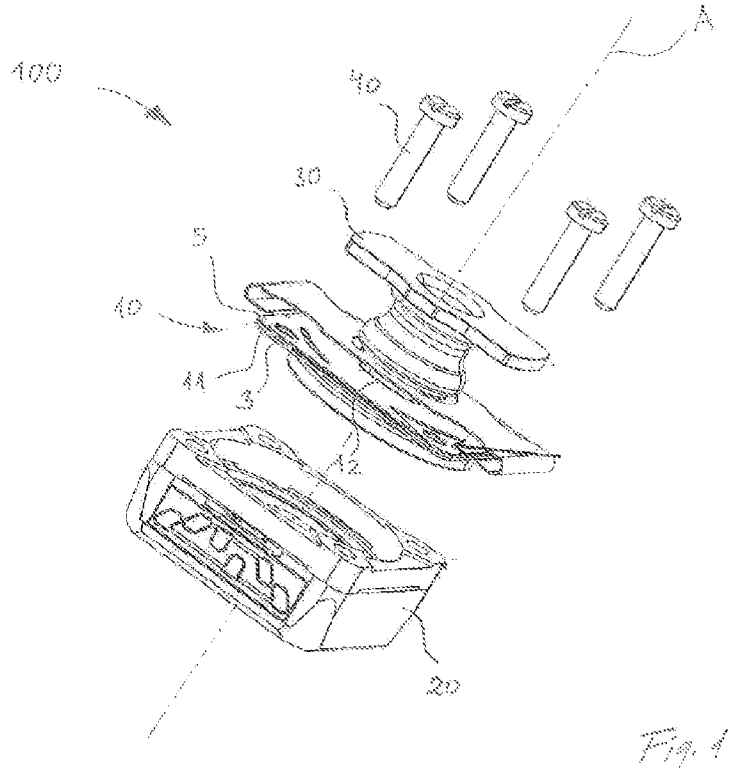
FIG. 1 schematically depicts an exploded view of a spring assembly as part of a vibrator.
Figure 6:
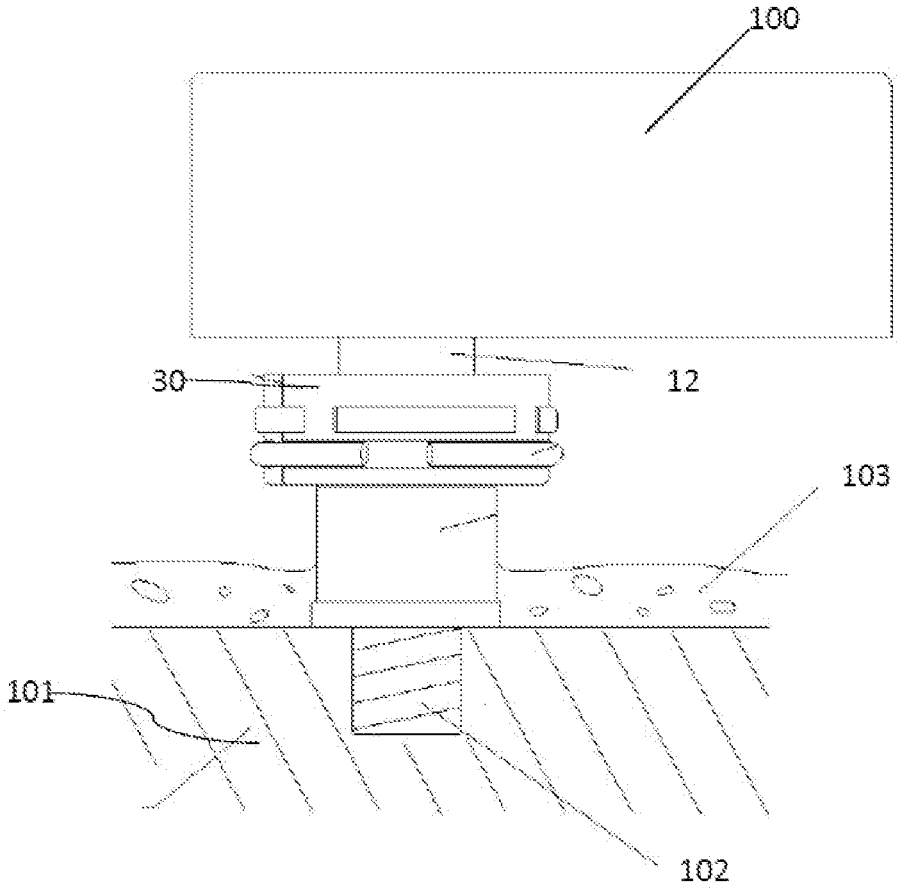
FIG. 6 shows a schematic view of a bone anchor and attached vibrator.

A vibrator 100 in FIG. 1 comprises a spring assembly 10, a mass 20, a coupling 30 attachable to a user's skull bone 101 (see FIG. 6) and a fastening means 40. The skull bone attachment could well be a screw 102 or similar bone anchor as shown in FIG. 6, which passes through the skin 103. The fastening means 40, which is provided as four screws, attaches the spring assembly 10 to the mass 20.

The spring assembly 10 comprises a suspension spring designed as a planar spring comprised of a base plate 3 and a cover plate 5. Base plate 3 and a cover plate 5 are of square shape and congruent to each other. Base plate 3 and cover plate 5 have a first end 11, which is designed as respective four bores, located in a peripheral region and a second end 12 located in a center region of their planes. The first end 11 is immovably connected to the mass 20, the second end 12 immovably connected to the coupling 30.

The base plate 3 and the cover plate 5 may be round or rounded in shape to follow the overall design of a vibrator which is the customary practice. In the present case the vibrator is square, but round or oblong vibrators are known in the art, and to such vibrators similarly shaped base and cover plates would be chosen. It should also be noted that a spring with base plate 5 and cover plate 3 having each their shape is a possibility and also the base and cover plate may have a shape, which deviates from the overall shape of the vibrator.

An axis of displacement A is defined perpendicular to the plane and extending through the center region.

As can be taken from FIG. 2, base plate 3 and cover plate 5 each comprise four slots 4 in proximity to respective corners of the square and equidistantly curved relative to the second end 12. The slots may however be restricted to only one of the base plate or cover plate and also the number and shape of slots may be varied in countless ways.

An adjusting means 1 is designed as a disk-shaped plate with a center hole. The adjusting means 1 comprises four pads 2 protruding from both planes of the disk-shape plate. The four pads 2 correspond to the each of the four slots 4 comprised by the base plate 3 and cover plate 5. If assembled, the pads 2 protrudes out of the plane of the disk-shaped plate of the adjustment means 1, and firmly abuts against base plate 3 and cover plate 5.

The adjusting means is rotatable against base plate 3 and a cover plate 5 and is disposed in-between in a sandwiched manner, allowing for the spring rate K to be steplessly adjusted.

The pads 2 correspond to the slot 4 such that by rotating the adjusting means 1 against the base plate 3 and a cover plate 5, the pads 2 are moved gradually from a first position completely covering slots 4 to a second position leaving the slots 4 completely uncovered. When the pads 2 are in the first position they stiffen the suspension spring to have the first spring rate K1. When the pads 2 are in the second position the suspension spring is softened to have the second spring rate.

The spring assembly 10 further comprises an outer spacer 7 disposed between the base plate 3 and the cover plate 5 in a sandwiched manner and in the same plane as the adjusting means 1. The outer spacer 7 is designed complementary to an outer perimeter of the adjusting means 1 to provide for rotational guidance. Base plate 3, cover plate 5 and outer spacer 7 but for a recess in the outer spacer 7 have the same circumferential square shape. Base plate 3, cover plate 5 and outer spacer 7 comprise bores being matched to the fastening means 40 designed as screws.

The spring assembly 10 comprises a center spacer 9 disposed between the base plate 3 and the cover plate 5 in a sandwiched manner within the center hole of the adjusting means 1. The center spacer 9 resides within the center hole of the adjusting means 1 contactless to the adjusting means 1.

The adjusting means 1 of a spring assembly 10 in FIG. 3 is in the first adjustment position. The slots 4 are completely covered by the pads 2. The suspension spring is stiffened to have the first spring rate K1, which is 320 N/mm.

The adjusting means 1 of a spring assembly 10 in FIG. 4 is in the second adjustment position. The slots 4 are completely uncovered. The suspension spring is softened to have the second spring rate K2, which is 190 N/mm.

Figure 5:
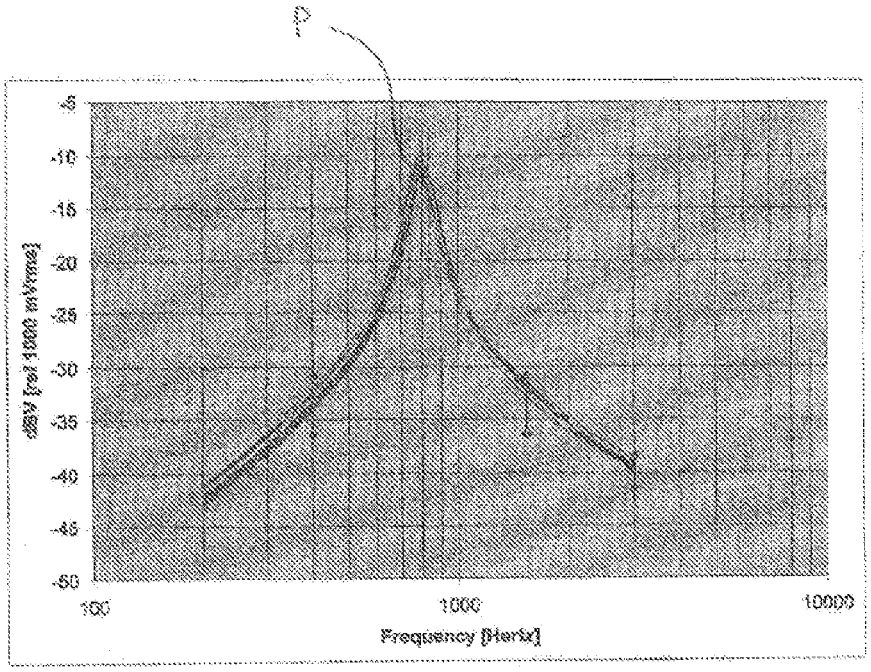
FIG. 5 schematically depicts a typical vibrator resonance peak.

Depicted in FIG. 5 is a typical desired range of a resonance peak of a vibrator lying between 740 Hz and 820 Hz.

The invention claimed is:

1. A spring assembly for a vibrator of a bone anchored hearing aid, the spring assembly comprising:

a suspension spring having a first end immovably connectable to a mass of the vibrator and a second end immovably connectable to a coupling attachable to a user's skull bone and comprised by the vibrator; and an adjuster configured to adjust a spring rate of the suspension spring between a first spring rate and a second spring rate, the first rate being higher than the second rate, so as to move a resonance peak of the vibrator, wherein the suspension spring is designed as a planar spring with the first end being located in a peripheral region, the second end in a center region of a plane of the spring, and an axis of displacement is defined perpendicular to the plane and extending through the center region.

2. The spring assembly according to claim 1, wherein the adjuster is adapted to adjust the spring rate steplessly.

3. The spring assembly according to claim 1, wherein the adjuster is embedded in the spring assembly such that the overall height of the spring assembly along the axis of displacement is constant for any adjusted spring rate.

4. The spring assembly according to claim 1, wherein the adjuster is designed as a disk-shaped plate with a center hole, wherein the plate is rotatable against the suspension spring on the axis of displacement, the spring rate being a function of the rotational angle of the plate.

5. The spring assembly according to claim 4, wherein the adjuster comprises a pad protruding from a plane surface of the adjuster firmly against the suspension spring, and the suspension spring comprises a slot located in the plane of the suspension spring, wherein the pad corresponds to the slot such, that by rotating the adjuster against the suspension spring the pad is moved gradually from a first position completely covering the slot to a second position leaving the slot completely uncovered, wherein the pad being in the first position stiffens the suspension spring to have the first spring rate, and the pad being in the second position softens the suspension spring to have the second spring rate.

6. The spring assembly according to claim 5, wherein the suspension spring is comprised of a base plate exhibiting the slot and a cover plate being congruent to the base pate with the adjuster disposed in-between in a sandwiched manner.

7. The spring assembly according to claim 6, wherein the spring assembly comprises an outer spacer disposed between the base plate and the cover plate in a sandwiched manner and in the same plane as the adjusting, wherein the outer spacer is designed complementary to an outer perimeter of the adjuster to provide for rotational guidance.

8. The spring assembly according to claim 7, wherein the spring assembly comprises a center spacer disposed between the base plate and the cover plate in a sandwiched manner within the center hole of the adjusting means.

9. The spring assembly according to claim 6, wherein the base plate and the cover plate are of square shape, each comprising four slots in proximity to respective corners of the square and equidistantly curved around the second end and the adjuster comprises four corresponding pads.

10. The spring assembly according to claim 6, wherein the base plate, cover plate and outer spacer but for a recess in the outer spacer have the same circumferential square shape, wherein the first end is designed as bores located in the respective corners of the squares defined by base plate, cover plate and outer spacer, the bores being matched to the fastener designed as screws.

11. The spring assembly according to claim 1, wherein the spring assembly is attached to the mass via a fastener such, that loosening the fastener allows for adjusting the spring constant, while tightening the fastener prevents a self-adjustment of the spring constant when the vibrator is in operation.

12. The spring assembly according to claim 1, wherein the spring rate of the suspension spring is steplessly adjustable between about 320 N/mm and 190 N/mm.

13. A vibrator for a bone anchored hearing aid, the vibrator having a spring assembly according to claim 1, wherein the suspension spring's first end is immovably connected to a mass of the vibrator and the second end is immovably connected to a coupling attachable to a user's skull bone and comprised by the vibrator.

14. A bone anchored hearing aid having a vibrator according to claim 13.

* * * * *